United States Patent [19]

Graham et al.

[11] 4,184,059

[45] Jan. 15, 1980

[54] ENCAPSULATED VACUUM SWITCH HAVING IMPROVED SWITCH ARM SEAL

[75] Inventors: Richard Graham, Centralia; Eugene L. Kamp, Fulton; Armin M. Bruning; Earl S. Gritton, both of Centralia; L. Ronald Azdell, Mexico, all of Mo.

[73] Assignee: A. B. Chance Company, Centralia, Mo.

[21] Appl. No.: 846,844

[22] Filed: Oct. 31, 1977

[51] Int. Cl.[2] ..... H01H 9/04; H01H 21/08

[52] U.S. Cl. ..... 200/302; 174/17 LF

[58] Field of Search ..... 174/8 R, 11 R, 12 R, 174/14 R, 17 R, 17 LF, 46; 74/558.5, 566; 205/302

[56] References Cited

U.S. PATENT DOCUMENTS

| | | | |
|---|---|---|---|
| 461,239 | 10/1891 | Foster | 200/52 R |
| 2,575,726 | 11/1951 | Peck | 174/17 R X |
| 2,914,744 | 11/1959 | Schendel | 174/12 R X |
| 3,522,404 | 8/1970 | Trayer | 200/302 |
| 3,602,679 | 8/1971 | Odom | 200/302 |
| 3,878,314 | 4/1975 | Link | 200/302 X |

*Primary Examiner*—Herbert F. Ross

*Attorney, Agent, or Firm*—Schmidt, Johnson, Hovey & Williams

[57] ABSTRACT

A high dielectric strength seal between the encapsulant and the outwardly projecting actuating arm of an externally operable encapsulated vacuum switch includes a fluid-receiving sealed cavity surrounding the actuating arm between the latter and the encapsulant. An externally accessible valve permits charging of the cavity with a dielectric fluid subsequent to encapsulation of the switch to insure displacement of air from the interface between the encapsulant and actuating arm, thereby greatly reducing the likelihood of corona formation and dielectric breakdown of the seal. Additionally, the dielectric fluid may be pressurized through the valve to preclude infusion of conductive contaminants into the cavity. In preferred forms, an accumulator is in fluid communication with the cavity to permit thermal expansion and contraction of the dielectric fluid without undesired leakage or cavitation of the liquid.

7 Claims, 6 Drawing Figures

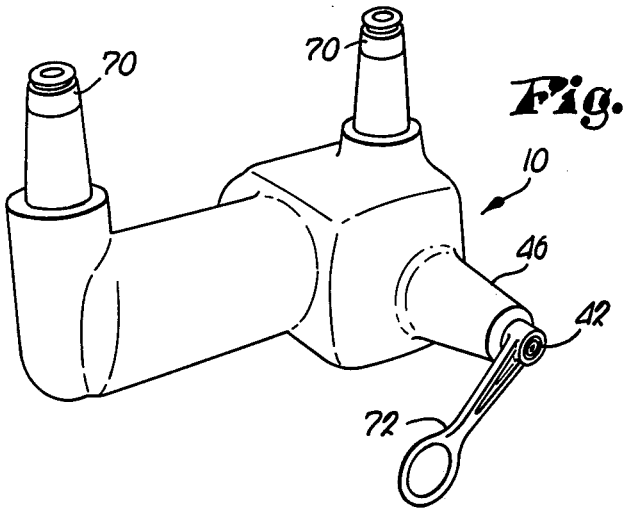
Fig. 1.
Fig. 2.
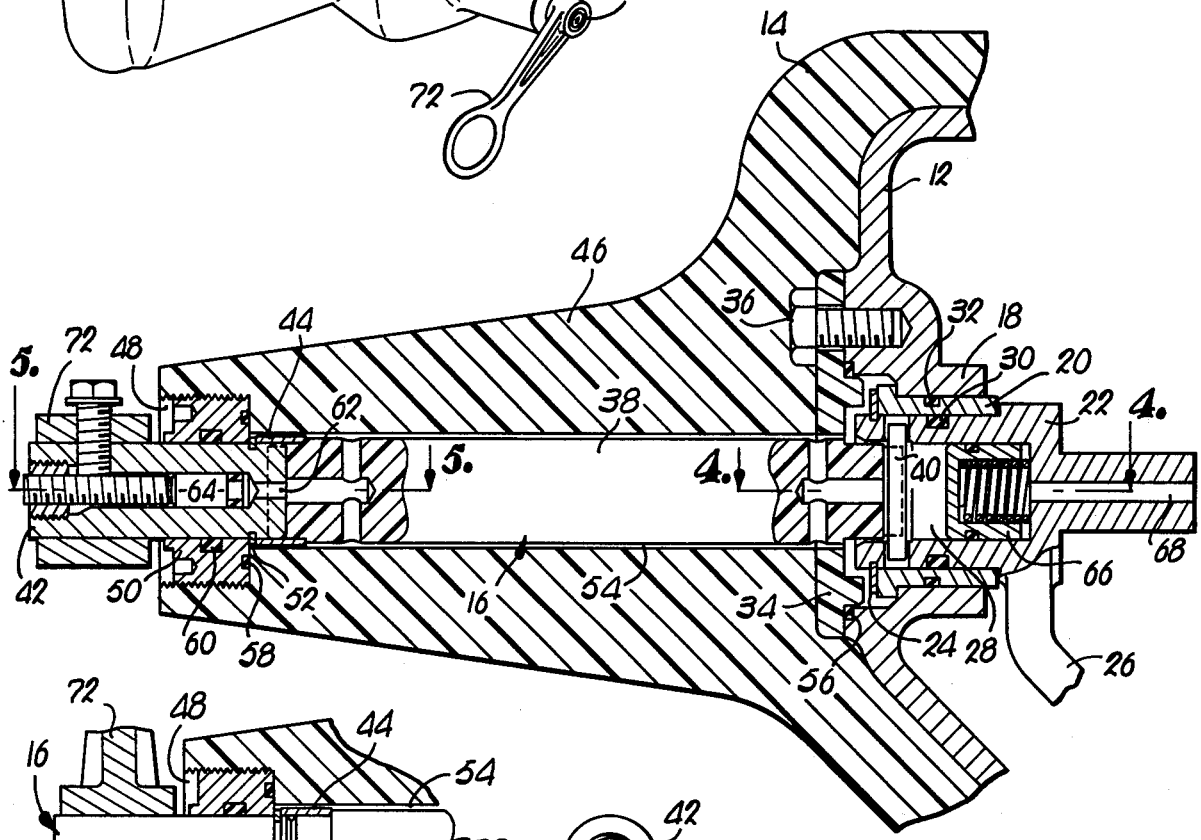
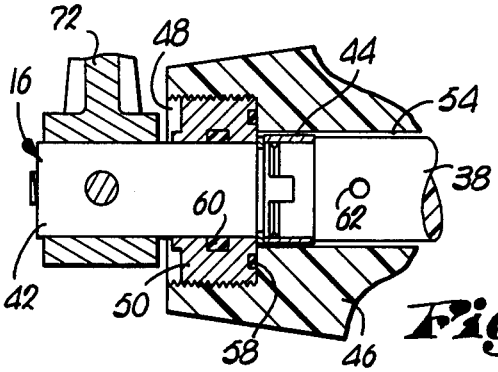
Fig. 5.
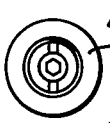
Fig. 6.
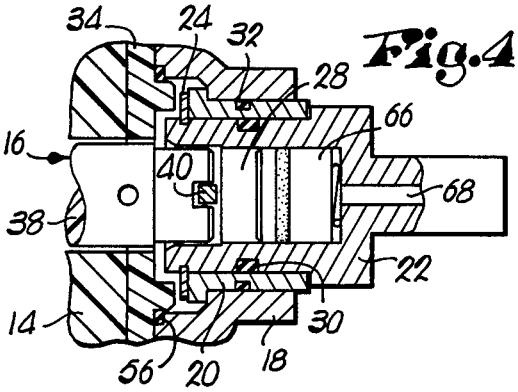
Fig. 4.
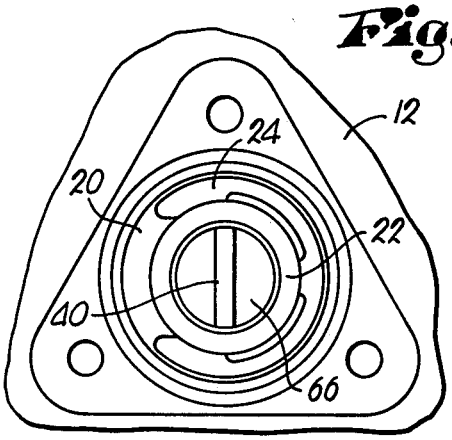
Fig. 3.

ENCAPSULATED VACUUM SWITCH HAVING IMPROVED SWITCH ARM SEAL

This invention relates to high-voltage encapsulated switchgear in general, and is particularly concerned with a high insulative strength seal between the encapsulant and the actuating arm of an externally operable encapsulated switch.

In recent years, encapsulated switchgear has become increasingly accepted as a better alternative to the use of conventional gas- or liquid-insulated high-voltage electrical equipment. The bulky and unsightly housings required for conventionally insulated switchgear are simply no longer desirable in modern distribution systems, particularly in underground installations where space is at a premium. By utilization of appropriate high dielectric strength resinous encapsulants, it is possible to fabricate encapsulated high-voltage switchgear which is reduced in size manyfold over conventionally insulated switchgear of similar electrical rating. One example of such devices is the encapsulated vacuum switch assembly disclosed in U.S. Pat. No. 3,471,669 issued to Curtis.

Manifestly, the dielectric strength of an encapsulated device is reduced at locations where it is necessary to penetrate the encapsulant. This is true even in instances where the penetrating member is itself a strong dielectric inasmuch as there is a tendency for moisture and other contaminants to infiltrate the interface between the encapsulant and the penetrating member thereby providing an environment for corona formation and dielectric breakdown. The aforementioned problem is particularly acute in externally operable encapsulated switchgear where the member penetrating the encapsulant is necessarily shiftable relative to the latter, consequently greatly increasing the liklihood of contaminant infusion along the interface therebetween.

Of course, one approach to the above described problem is simply to extend the length of the interface between the encapsulant and the penetrating member sufficiently to provide desired insulative strength at this location. However, this solution is not acceptable from a space saving standpoint; such as elongated construction partially negates the primary advantage offered by encapsulated switchgear.

Another approach to the problem is to provide a high dielectric strength seal at the critical interface as illustrated in U.S. Pat. No. 3,602,679 issued to Odom. The seal disclosed in this patent comprises an elongate elastic sleeve disposed in dialated condition over a shiftable switch-actuating arm intermediate the latter and the encapsulant. By this construction, there is provided a relatively fluid-tight seal between the encapsulant and operating shaft to effectively reduce the liklihood of contaminants infiltrating therebetween.

While the seal described in the Odom patent has proved satisfactory in meeting insulation strength requirements for 15 kv rated switches, known manufacturing processes for fabricating such seals have resulted in an unacceptably high scrap rate. This high scrap rate is in large measure attributable to entrapment of air between the elastic sleeve and the encapsulant during fabrication. The entraped air contributes to corona formation during testing of the switch, which of course results in progressive dielectric breakdown along the critical interface and failure of the switch to meet required insulation standards.

Further, it does not appear possible with the Odom design to meet insulation strength requirements for higher rated switches in the 25 to 35 kv range. In this latter regard, the required basic impulse insulation level (BIL) for 25 kv and 35 kv rated switches is 125 kv and 150 kv respectively whereas the BIL for a 15 kv rated switch is only 95 kv. While the Odom design can achieve a BIL of 95 kv, it cannot realistically meet the BIL requirements for the 25 kv and 35 kv switches without significantly increasing the dimensions of the switch-actuating arm.

SUMMARY OF THE INVENTION

The present invention is concerned with an improved seal between the actuating arm and encapsulant of an externally operable, encapsulated high-voltage electrical device, which seal exhibits a sufficiently increased BIL over conventional seals as to permit electrical upgrading of the device without increasing the physical dimensions of the latter.

The seal of the present invention includes a hermetic annular cavity extending around the switch-actuating arm intermediate the latter and the encapsulant, and a pressurized volume of high dielectric fluid disposed within the sealed cavity. By this arrangement, all air is displaced from the interface between the encapsulant and the actuating arm to reduce the likelihood of corona formation and further, the pressurized fluid serves to preclude infiltration of exterior contaminants into the critical interface. An accumulator in communication with the cavity is provided to preserve the integrity of the pressurized fluid under expansion and contraction effected by thermal cycling.

While the major portion of the actuating arm is constructed of high dielectric material, there is provided an outermost metallic segment which extends into the cavity for the purpose of precluding migration of the dielectric fluid from the interior of the cavity by capillary action.

There is provided an exteriorly accessible valve communicating with the cavity for permitting evacuation of the latter and introduction of dielectric fluid thereinto after the encapsulation process has been completed, rather than introducing the dielectric prior to encapsulation as required with previous designs. This arrangement virtually eliminates the problem of air entrapment at the critical interface and hence the manufacturing scrap rate is considerably reduced with the seal of the present invention. Additionally, the valve permits in service replacement of the dielectric fluid should this appear desirable.

BRIEF DESCRIPTION OF THE DRAWING

FIG. 1 is a perspective view of an encapsulated vacuum switch provided with an improved switch arm seal constructed in accordance with the principles of the present invention;

FIG. 2 is an enlarged, fragmentary, cross-sectional view taken along the longitudinal axis of the switch arm of the encapsulated switch illustrated in FIG. 1;

FIG. 3 is an enlarged, fragmentary, detail view of the switch housing showing the coupling which mates with the base of the switch arm;

FIG. 4 is an enlarged, fragmentary, cross-sectional view taken along line 4—4 of FIG. 2;

FIG. 5 is an enlarged, fragmentary, cross-sectional view taken along line 5—5 of FIG. 2; and FIG. 6 is an enlarged, end view of the outermost end of the switch arm.

DETAILED DESCRIPTION

Throughout the drawing there is shown a high-voltage encapsulated vacuum switch 10 including a metal housing 12 containing a conventional vacuum interrupter unit (not shown), an insulative jacket 14 encapsulating the housing 12, and a switch-actuating arm 16 operably intercoupled with the interrupter unit and extending outwardly from the housing 12 through the jacket 14. The switch 10 is intended for dead-front applications in vault or pad mounted distribution switchgear.

As shown in FIG. 2, an annular boss 18 formed around an opening in the housing 12 has a press fit bushing 20 seated therein which in turn rotatably supports a coupling member 22 on the housing 12. The member 22 is secured in place by a retaining ring 24 and is provided with a crank arm 26 operably interconnecting the member 22 to the interrupter unit through conventional linkage (not shown) such that the interrupter unit is opened and closed by rotation of the member 22 in an appropriate direction. The member 22 is provided with an outwardly facing, cylindrical recess 28 concentric with its axis of rotation.

As further shown in FIG. 2 and 4, an O-ring 30 is provided at the interface between bushing 20 and member 22 and a similar O-ring 32 is provided at the interface between the bushing 20 and housing 12. Moreover, the opening in the housing 12 adjacent the boss 18 is substantially covered by a triangular, nonconductive plate 34 bolted to the housing 12 by a number of nylon bolts 36, there being a central aperture in the plate 34 permitting access of the arm 16 to the member 18 for coupling thereof in a manner to be described.

The switch-actuating arm 16 comprises a cylindrical, glass laminate epoxy inner segment 38 having a transverse kerf formed in its innermost end which engages a cross pin 40 on the member 22 in a manner to permit transmission of torque between the member 22 and the segment 38. A metallic, cylindrical outer segment 42 is held in axial end-to-end alignment with the segment 38 by a rigid metal collar 44 as shown in FIG. 2, there being a transverse tongue and groove coupling between the adjacent ends of segments 38, 42 whereby torque may be transmitted between the segments 42 and 38.

The jacket 14 is formed of high dielectric material comprising epoxy filled with quartz and glass fibers or beads. An outwardly extending frustoconical portion 46 is formed in the jacket 14 extending along the length of the arm 16 in concentric relation to the latter. The outermost end of the frustoconical portion 46 has a concentric, threaded cylindrical recess 48 which matingly receives an annular collar 50 for the purpose of releasably retaining the arm 16 in engagement with the member 22 as shown in FIG. 2. In this regard, there is provided on the segment 42 a retainer ring 52 which abuts against the collar 50 when the latter is disposed within the recess 48, such that the segment 42 (and hence arm 16) is captively held against axial movement away from the member 22.

A generally annular hermetic cavity 54 surrounds the arm 16 intermediate the latter and the portion 46 as best illustrated in FIG. 2. The innermost end of the cavity 54 is sealed by O-rings 30, 32 in addition to a third O-ring 56 disposed between the housing 12 and the plate 34. The outermost end of the cavity 54 is similarly sealed by an O-ring 58 disposed intermediate the collar 50 and the frustoconical portion 46, and an O-ring 60 positioned between the collar 50 and the segment 42 of arm 16.

External access to the cavity 54 is provided by valve means in the form of an externally opening passage 62 formed in the arm 16 and communicating with the cavity 54, in combination with a seat 64 removably disposed within the passage 62 for selectively opening or closing the latter.

In preferred forms, the cavity 54 is filled with a high dielectric fluid, such as mineral oil, whereby virtually all air is displaced from the intimate interface between the arm 16 and the frustoconical portion 46 of jacket 14. Charging of the cavity 54 with dielectric fluid is accomplished through the valve means defined by passage 62 and seat 64. Initially, the seat 64 is removed to open passage 62 whereupon a vacuum is drawn on the cavity 54 to evacuate the latter. With the cavity 54 evacuated, the dielectric fluid is introduced thereinto through the passage 62. The fluid is placed under positive pressure as the seat 64 is repositioned to close the passage 62.

A spring loaded piston-type accumulator 66 disposed within the recess 28 of member 22 is in direct fluid communication with the cavity 54 whereby to accomodate thermal expansion and contraction of the dielectric fluid. A vent 68 for the accumulator 66 opens into the interior of the housing 12 thereby reducing the liklihood of contaminants being introduced into the cavity 54 through the accumulator 66.

As shown in FIG. 1, the switch 10 is provided with a pair of spaced insulated female connectors 70 each adapted to receive a mating male connector or respective conductors when the switch 10 is placed in service. There is also provided a lever 72 secured to the segment 42 for the purpose of facilitating rotation of the arm 16 as desired to effect opening or closing of the switch 10.

The operation of the vacuum switch 10 is substantially the same as any conventional encapsulated vacuum switch. The significant difference between the switch 10 and conventional switches being the ability to meet BIL requirements for up to 35 kv rated equipment without requiring increased length of the actuating arm 16 and the frustoconical portion 46 of jacket 14. This significant advantage is the direct result of the improved seal between the arm 16 and the portion 46 as defined by cavity 54 and the dielectric fluid contained therewithin.

As the fluid within the cavity 54 expands and contracts in response to thermal cycling experienced under normal operating conditions, accumulator 66 shifts within the cavity 28 to compensate for the increased or reduced volume of the dielectric fluid within the cavity 54. Hence, there is avoided fluid leakage from the cavity 54 which would result from high fluid pressure ordinarily generated upon experiencing increased temperature. Similarly, low temperature cavitation in the cavity 54 is avoided such that the likelihood of exterior contaminants being drawn into the cavity 54 under low temperature conditions is greatly reduced.

It is considered an important advantage of the present invention that the dielectric fluid may be introduced into the cavity 54 after the formation of the encapsulating conformal jacket 14. This is in direct contrast with prior art fabrication procedures wherein dielectric greases are required to be applied prior to encapsulation, thereby creating contamination and adherence problems with the encapsulant. Hence, the seal of the present invention avoids the manufacturing problems and high scrap rate associated with prior art seals.

In light of the foregoing, it is clear that the switch arm seal of the present invention offers a significant improvement over those heretofore available. Indeed, actual tests on encapsulated vacuum switches provided with the improved seal of our invention indicate that the seal is no longer the point of weakest insulative strength in the encapsulated switch. That is to say, dielectric breakdown now occurs at other locations when performing BIL tests on switches having seals constructed in accordance with the principles of the present invention.

Moreover, the high dielectric strength seal of the instant invention may be fabricated with a low scrap rate using only conventional processing techniques. Hence, the invention may be cost-competitive with other types of seals employing less hardware but experiencing high scrap rates in production.

What we claim is:

1. In an encapsulated, externally operable electrical device having a shiftable actuating arm penetrating through said encapsulant, an improved, high dielectric strength seal between the encapsulant and the arm, said seal including:

a hermetic, annular cavity surrounding said arm between the latter and said encapsulant;

a pressurized volume of dielectric fluid disposed within and substantially filling said cavity whereby to exclude all air from the cavity and to preclude infiltration of conductive contaminants thereinto;

means for accommodating thermal expansion and contraction of said volume of fluid without significant pressure change whereby to preclude leakage of fluid at relatively high temperature as well as prevent cavitation in the fluid at relatively low temperature; and externally accessible valve means for permitting said dielectric fluid to be introduced into said cavity subsequent to encapsulation of said device, said valve means comprising an externally-opening passage communicating with said cavity and a removable seat in said passage for selectively opening and closing the latter, said valve means being disposed on said arm.

2. The invention of claim 1, said device including a conductive housing, there being a non-conductive plate secured to the housing adjacent said cavity.

3. The invention of claim 1; said arm being axially rotatable relative to said encapsulant, there being means for releasably securing said arm against removal from said encapsulant.

4. In an encapsulated, externally operable electrical device having a shiftable actuating arm penetrating through said encapsulant, an improved, high dielectric strength seal between the encapsulant and the arm, said seal including:

a hermetic, annular cavity surrounding said arm between the latter and said encapsulant;

a pressurized volume of dielectric fluid disposed within and substantially filling said cavity whereby to exclude all air from the cavity and to preclude infiltration of conductive contaminants thereinto; and means for accommodating thermal expansion and contraction of said volume of fluid without signficant pressure change whereby to preclude leakage of fluid at relatively high temperature as well as prevent cavitation in the fluid at relatively low temperature, said arm including a dielectric segment circumscribed by said cavity, and a nonpermeable segment coupled to said dielectric segment with a tongue and groove coupling and projecting outwardly away from the cavity, the coupling between said segments being disposed within said cavity.

5. The invention of claim 4, said segments being disposed in end-to-end alignment.

6. The invention of claim 4, and a collar holding said segments in alignment.

7. In an encapsulated, externally operable electrical device having a shiftable actuating arm penetrating through said encapsulant, an improved, high dielectric strength seal between the encapsulant and the arm, said seal including:

a hermetic, annular cavity surrounding said arm between the latter and said encapsulant;

a pressurized volume of dielectric fluid disposed within and substantially filling said cavity whereby to exclude all air from the cavity and to preclude infiltration of conductive contaminants thereinto; and means for accommodating thermal expansion and contraction of said volume of fluid without significant pressure change whereby to preclude leakage of fluid at relatively high temperature as well as prevent cavitation in the fluid at relatively low temperature, said thermal expansion means comprising an accumulator, said accumulator being vented to the interior of said device.

* * * * *